US007329331B2

(12) United States Patent
Bulan et al.

(10) Patent No.: US 7,329,331 B2
(45) Date of Patent: Feb. 12, 2008

(54) ELECTROLYSIS CELL, ESPECIALLY FOR ELECTROCHEMICAL PRODUCTION OF CHLORINE

(75) Inventors: Andreas Bulan, Langenfeld (DE); Fritz Gestermann, Leverkusen (DE); Manfred Marre, Köln (DE); Walter Hansen, Leverkusen (DE); Michael Groβholz, Leverkusen (DE)

(73) Assignee: Bayer MaterialScience AG, Leverkusen (DE)

( * ) Notice: Subject to any disclaimer, the term of this patent is extended or adjusted under 35 U.S.C. 154(b) by 277 days.

(21) Appl. No.: 10/491,621

(22) PCT Filed: Sep. 19, 2002

(86) PCT No.: PCT/EP02/10516

§ 371 (c)(1),
(2), (4) Date: Oct. 4, 2004

(87) PCT Pub. No.: WO03/031690

PCT Pub. Date: Apr. 17, 2003

(65) Prior Publication Data

US 2005/0173257 A1 Aug. 11, 2005

(30) Foreign Application Priority Data

Oct. 2, 2001 (DE) ..... 101 48 600

(51) Int. Cl.
*C25B 9/12* (2006.01)

(52) U.S. Cl. ..... 204/265; 204/266; 204/263; 204/252

(58) Field of Classification Search ..... 204/252, 204/265, 266, 263
See application file for complete search history.

(56) References Cited

U.S. PATENT DOCUMENTS

| | | | | |
|---|---|---|---|---|
| 4,350,580 | A | 9/1982 | Kadija | |
| 5,693,202 | A | 12/1997 | Gestermann et al. | |
| 5,770,035 | A | 6/1998 | Faita | |
| 6,113,757 | A | 9/2000 | Shimamune et al. | |
| 6,841,047 | B2 * | 1/2005 | Gestermann et al. | 204/252 |

FOREIGN PATENT DOCUMENTS

| | | | |
|---|---|---|---|
| DE | 4444114 | A1 | 9/1996 |
| EP | 1029946 | A2 | 8/2000 |
| EP | 1041176 | A1 | 10/2000 |
| EP | 1092789 | A1 | 4/2001 |
| JP | 09078279 | A1 | 3/1997 |
| WO | WO-03/023090 | A1 | 3/2003 |

* cited by examiner

*Primary Examiner*—Bruce F. Bell
(74) *Attorney, Agent, or Firm*—Connolly Bove Lodge & Hutz LLP

(57) ABSTRACT

An electrolysis cell, suitable for the electrochemical production of chlorine from aqueous solutions of hydrogen chloride. The cell preferably comprises an anode space formed from an anode, an anode frame, and a back wall, the anode frame supporting the anode, and the anode space having an inlet and an outlet for the electrolyte, a cathode space formed from a current collector. The cell further preferably comprises a cathode frame and a back wall, the cathode frame supporting the current collector and the cathode space having an inlet and an outlet for the gas, a gas diffusion electrode arranged between anode and current collector and an cation exchange membrane arranged between anode and gas diffusion electrode, wherein the gas diffusion electrode is fixed on the current collector.

20 Claims, 6 Drawing Sheets

ELECTROLYSIS CELL, ESPECIALLY FOR ELECTROCHEMICAL PRODUCTION OF CHLORINE

CROSS REFERENCE TO RELATED APPLICATIONS

This application is a 35 U.S.C. 371 national stage U.S. application of International Application No. PCT/EP02/10516 filed Sep. 19, 2002, which claims priority to German Patent Application No. 10148600.6 which was filed on Oct. 2, 2001.

BACKGROUND OF THE INVENTION

The invention relates to an electrolysis cell, in particular for the electrochemical production of chlorine from aqueous solutions of hydrogen chloride.

It is known that the electrolysis of hydrochloric acid can be carried out in an electrolysis cell in which the anode space with a noble metal-coated anode is filled with hydrochloric acid and in which an oxygen-containing gas or pure oxygen is present in the cathode space. As described, for example, in U.S. Pat. No. 5,770,035, anode space and cathode space are separated from one another by a cation exchange membrane, the cation exchange membrane resting on a gas diffusion electrode, referred to below as GDE. The gas diffusion electrode rests on the current collector.

JP-A-9 078 279 states that the GDE is adhesively bonded to the cation exchange membrane. A disadvantage here is that the GDE has to be cut out exactly and then adhesively bonded exactly to the cation exchange membrane. This process is inconvenient and expensive. In addition, in the event of damage to the membrane or the GDE, both the GDE and the membrane have to be replaced.

SUMMARY OF THE INVENTION

It is an object of the invention to provide an electrolysis cell which operates reliably and is easy to handle.

The object is achieved, according to the invention, by the features of claim 1.

DETAILED THE DESCRIPTION OF THE DRAWINGS

The electrolysis cell according to the invention has an anode space supported by an anode frame, a current collector supported by a cathode frame, and a gas diffusion electrode (GDE) arranged between the anode and the current collector, such as, for example, an oxygen-consuming electrode. Furthermore, the electrolysis cell has a cation exchange membrane likewise arranged between the anode and the current collector. The anode space is formed from the anode, the anode frame and the back wall and has an inlet and an outlet for the electrolyte. The cathode space is formed from the current collector, the cathode frame and the back wall and has an inlet and an outlet for gas, in the case of an oxygen-consuming cathode, for oxygen or oxygen-containing gas.

According to the invention, the GDE is fixed on the current collector. Compared with adhesive bonding of the GDE to the cation exchange membrane, this has the advantage that, in the event of damage to the GDE or the cation exchange membrane, it is not necessary to replace both components.

The fastening of the GDE on the current collector has a further advantage that slipping of the GDE is avoided. The formation of hydrogen at the exposed current collector is thus likewise avoided.

By means of the fastening of the GDE on the current collector, according to the invention, it is possible to arrange the GDE in such a way that boundary regions of the GDE need not be arranged between seals. It is therefore possible to utilize substantially the total area of the GDE.

The GDE can be joined to the current collector by adhesive bonding. Since, by means of the adhesive bonding, it is intended primarily to prevent slipping of the GDE during installation and, in the assembled state, no large forces act on the GDE since it is clamped between the anode of the cation exchange membrane and the current collector, it is sufficient to adhesively bond the GDE to the current collector only at a few points. For example, in the case of a perpendicularly arranged electrolysis cell, it may be sufficient to adhesively bond the GDE only in the upper region. By the provision of few adhesive surfaces or only of adhesive points, impairment of the behavior of the GDE due to the adhesive, which, for example, may have a sealing effect, is reduced.

Preferably, the GDE is detachably fastened to the current collector. Detachable fastening can be effected, for example, by sewing to the current collector in the form of, for example, a perforated metal sheet or the like. A suitable plastics filament which is not attacked by the chemicals present in the electrolysis cell is used for this purpose. It is also possible to provide an interlocking connection, such as, for example, a hook and loop fastener, between the GDE and the current collector.

It would also be possible to clamp the GDE together with the cation exchange membrane between the anode frame and the cathode frame. Any additional seals would be provided hereby. In this arrangement, it would be ensured that the GDE completely covers the current collector, but the GDE is exposed to the large forces occurring during operation. The forces are the result of a hydrostatic pressure difference between the anode space and the cathode space, which is necessary for pressing the GDE against the current collector. In the case of a GDE clamped between the two frames, these forces may lead to damage to the GDE or to the cation exchange membrane in the sealing region. If tears occur in the GDE, an undesired increase in the electrolysis voltage is the result. Moreover, the current collector is exposed in the region of the tears in the GDE, so that undesired formation of hydrogen takes place. If, on the other hand, tears occur in the cation exchange membrane, chlorine enters the oxygen present in the cathode space. If, as in the customary procedure, the oxygen is used in excess, chlorine emerges together with the oxygen from the cell and then has to be separated off or removed by an expensive procedure. As a result of the considerable stretching, furthermore, reuse of the cation exchange membrane is not possible or the risk of tearing is increased on further use.

Since, according to the invention, the GDE is not firmly connected to the cation exchange membrane, corresponding stretching stresses do not occur in an outer region of the GDE. The occurrence of tears and the disadvantages associated therewith are thus avoided. Rather, greater mobility of the GDE is ensured. A further advantage of the GDE arrangement according to the invention consists in the fact that substantially the total area of the GDE is utilized since a part of the area is not covered by clamping between the two frames.

In order to ensure complete covering of the current collector by the GDE, the GDE is preferably slightly larger than the current collector. On assembly, this GDE edge projecting beyond the current collector is, for example, then pressed gently into the gap between the current collector and the cathode frame. The outer edge of the GDE thus rests against the cathode frame.

A sealing element, which preferably has substantially the dimensions of the cathode frame, and the GDE are preferably arranged in such a way that a sealing surface of the sealing element, which surface faces the anode, and the GDE surface likewise facing the anode are arranged in a plane. This ensures that the GDE rests both against the current collector and against the cation exchange membrane. This prevents, for example, buckling or slipping of the GDE. In this embodiment, in the assembled state, the thickness of the sealing element preferably substantially corresponds to the thickness of the GDE. Here, the current collector is substantially flush with the cathode frame, so that the current collector and the top of the frame form a plane on which the sealing element can then be placed in the region of the cathode frame and the GDE can be placed on the current collector itself, and said sealing element and said GDE in turn have a common plane facing the anode.

In a further embodiment, the current collector is bent over at two side edges, for example opposite one another, or at all four side edges, the edge regions projecting into the cathode space and a gap being formed between the edge regions of the current collector and the cathode frame. The current collector and that surface of the cathode frame which faces the anode space substantially form a plane. In this embodiment, the GDE is likewise bent over in the edge region. Here, the edges of the GDE are pushed into the gap between current collector and cathode frame.

In a further embodiment, the current collector is joined to the cathode frame in such a way that the surface of the current collector is not flush with that surface of the cathode space which faces the anode but projects beyond it. This provides a thicker seal whose thickness is greater than the distance by which the current collector projects beyond the cathode frame. This has the advantage that the position of the seal is defined by the current collector. Furthermore, the seal in turn forms a frame into which the GDE can be inserted. The GDE is fixed on the current collector, for example by sewing on or by means of adhesive points. This has the advantage that the position of these elements is exactly defined on assembly of the electrolysis cell.

In a further preferred embodiment of the invention, a sealing element which at least partly surrounds the gas diffusion electrode and has an extension projecting between the cathode frame and the current collector is provided. For fixing the gas diffusion electrode, the gas diffusion electrode is held between the extension and the current collector. Holding is effected in particular by clamping.

Instead of or in addition to the provision of an extension on the sealing element, it is possible to provide a resilient wedge for fixing the GDE. In this embodiment, the resilient wedge is arranged between the current collector and the seal. It may be an individual, preferably frame-like resilient wedge which surrounds the GDE. Furthermore, a plurality of wedges arranged a distance apart can be provided for fixing the GDE.

In a further embodiment, the fixing of the GDE is effected by virtue of the fact that the GDE partly grips around or behind the current collector. The gripping is preferably effected at two opposite sides of the current collector or, in the case of a current collector which, for example, is rectangular, on all four sides. For this purpose, one edge of the GDE can be connected to a rail in order to permit simple fixing to the current collector. The rail, which may be, for example, a plastics strip, is formed here in such a way that it can be pushed through a gap between the current collector and the cathode frame.

BRIEF DESCRIPTION OF THE DRAWINGS

The invention is explained in more detail below on the basis of preferred embodiments with reference to the attached drawings.

DETAILED THE DESCRIPTION OF THE DRAWING

Figure 1:
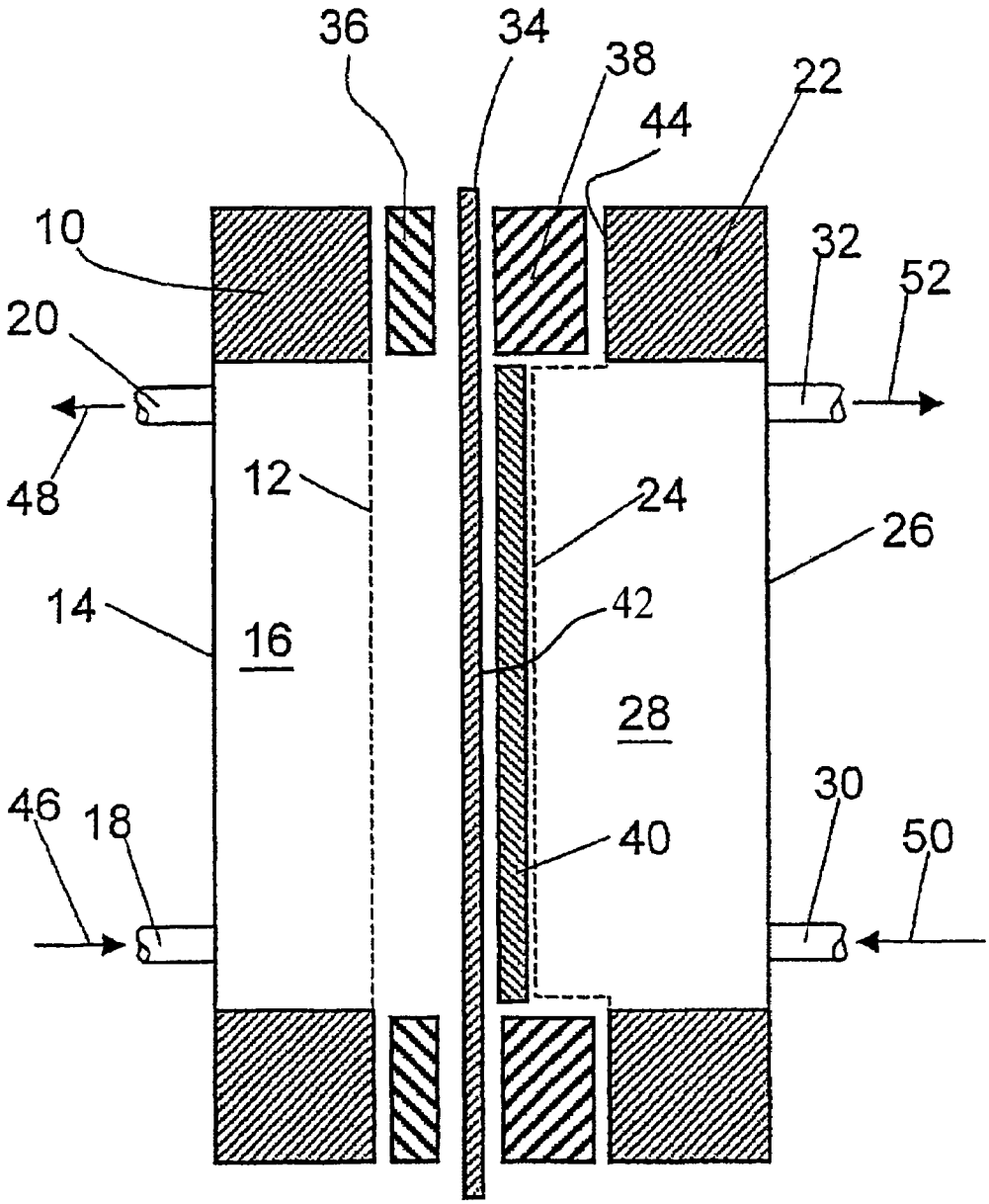
FIG. 1 shows a schematic longitudinal section of a first preferred embodiment of the electrolysis cell.

The electrolysis cell (FIG. 1) has an anode frame 10 which carries an anode 12. The anode frame 10 is furthermore connected to a back wall 14 so that an anode space 16 is formed by the anode frame 10, the back wall 14 and the anode 12. Furthermore, the anode frame 10 has an inlet 18 and an outlet 20.

A cathode frame 22 carries a current collector 24. Furthermore, the cathode frame 22 has a back wall 26 so that the cathode frame 22, the current collector 24 and the back wall 26 form a cathode space 28. Furthermore, the cathode frame 22 is connected to an inlet 30 and an outlet 32.

In the assembled state of the electrolysis cell, the two frames 10, 22 are clamped together. A cation exchange membrane 34 is provided for separating the anode space 16 from the cathode space 28. The cation exchange membrane 34 is larger than the anode 12 or the current collector 24, so that it too is arranged between the two frames 10, 22. The frames preferably have rectangular external dimensions. The cation exchange membrane is likewise rectangular so that the cation exchange membrane is arranged over the entire extent between the two frames 10, 22. For sealing, a sealing element 36 or 38 is provided on both sides of the cation exchange membrane 34. Furthermore, a gas diffusion electrode 40 is arranged between the cation exchange membrane 34 and the current collector 24. In the assembled state, the GDE 40 rests on the current collector 24 and the cation exchange membrane 34 rests against the GDE 40.

According to the invention, the GDE 40 is joined to the current collector 24 by clamping, adhesive bonding, hook and loop fasteners, sewing on or the like. Both the current collector 24 and the anode 12 are connected to electrical connections.

In the first preferred embodiment of the invention (FIG. 1), the current collector 24 projects beyond the cathode frame 22. The seal 38 has a thickness which is greater than the distance between the two surfaces 42, 44 of the cation exchange membrane 34 or of the cathode frame 22. The resulting projection forms a frame into which the GDE 40 can be inserted. This considerably simplifies the assembly.

In order to ensure that the current collector is covered by the GDE 40, the external dimension of the GDE 40 is slightly greater than that of the current collector 24. Preferably, the external dimension of the GDE 40 is slightly smaller than the dimension of the seal 38 so that it rests directly against the inside of the seal 36.

During the operation of the electrolysis cell, for example, hydrochloric acid is fed to the anode space 16 through the inlet 18 in the direction of the arrow 46. During the electrolysis, the hydrochloric acid is removed again through the outlet 32 in the direction of the arrow 48. Oxygen is fed to the cathode space 28 through the inlet 30 in the direction of the arrow 50 and escapes again through the outlet 32 in the direction of the arrow 52. During the electrolysis, chlorine is produced in the anode space 16 and escapes through the outlet 20 of the anode space 16. Other flow variants are also possible for flow through the anode space 16 as well as the cathode space 28.

The working examples shown in FIGS. 2 to 5 constitute in principle an electrolysis cell similar to the electrolysis cell shown in FIG. 1, so that identical or similar components are denoted by the same reference numerals.

Figure 2:
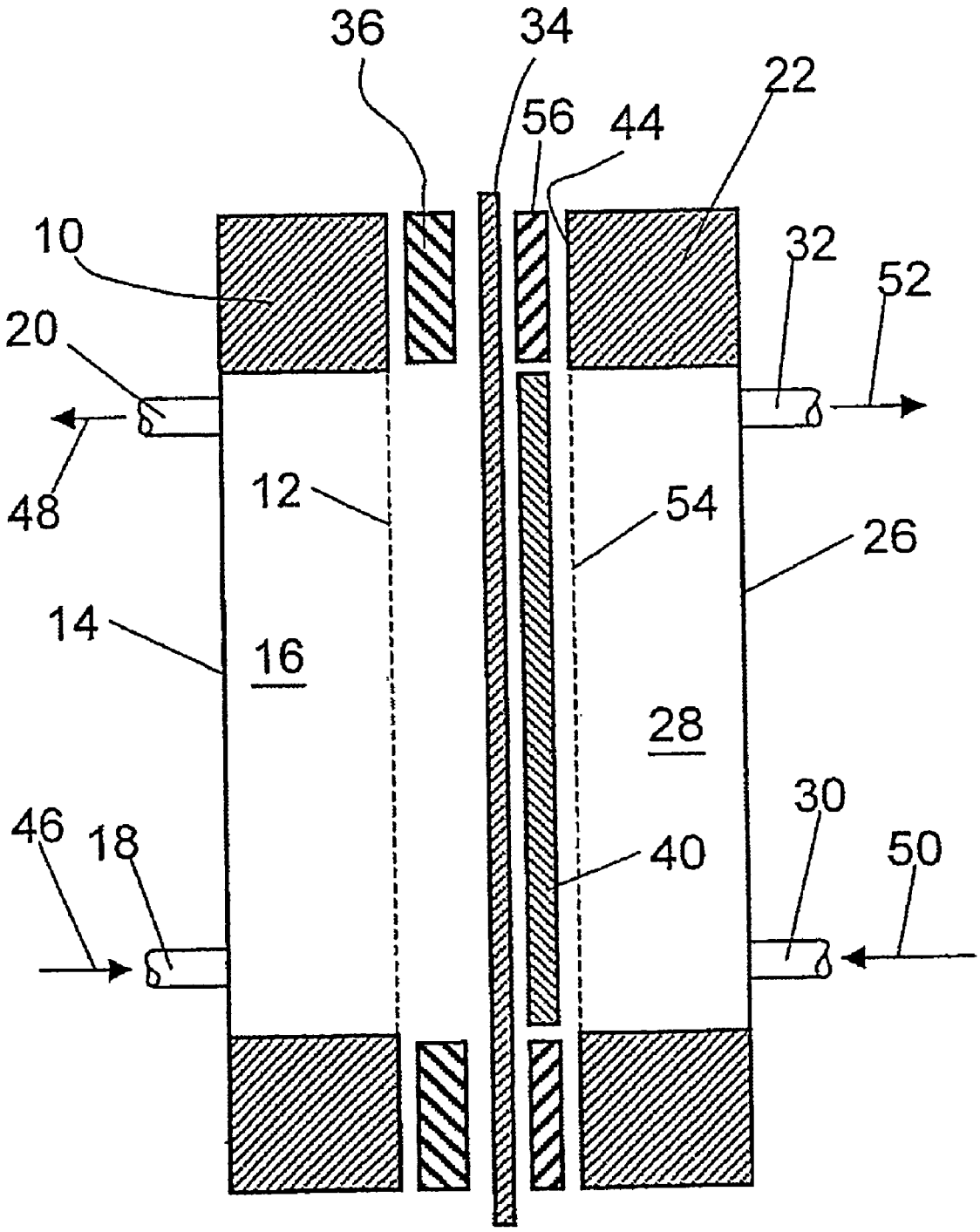
FIG. 2 shows a schematic longitudinal section of a second preferred embodiment of the electrolysis cell.
Figure 3:
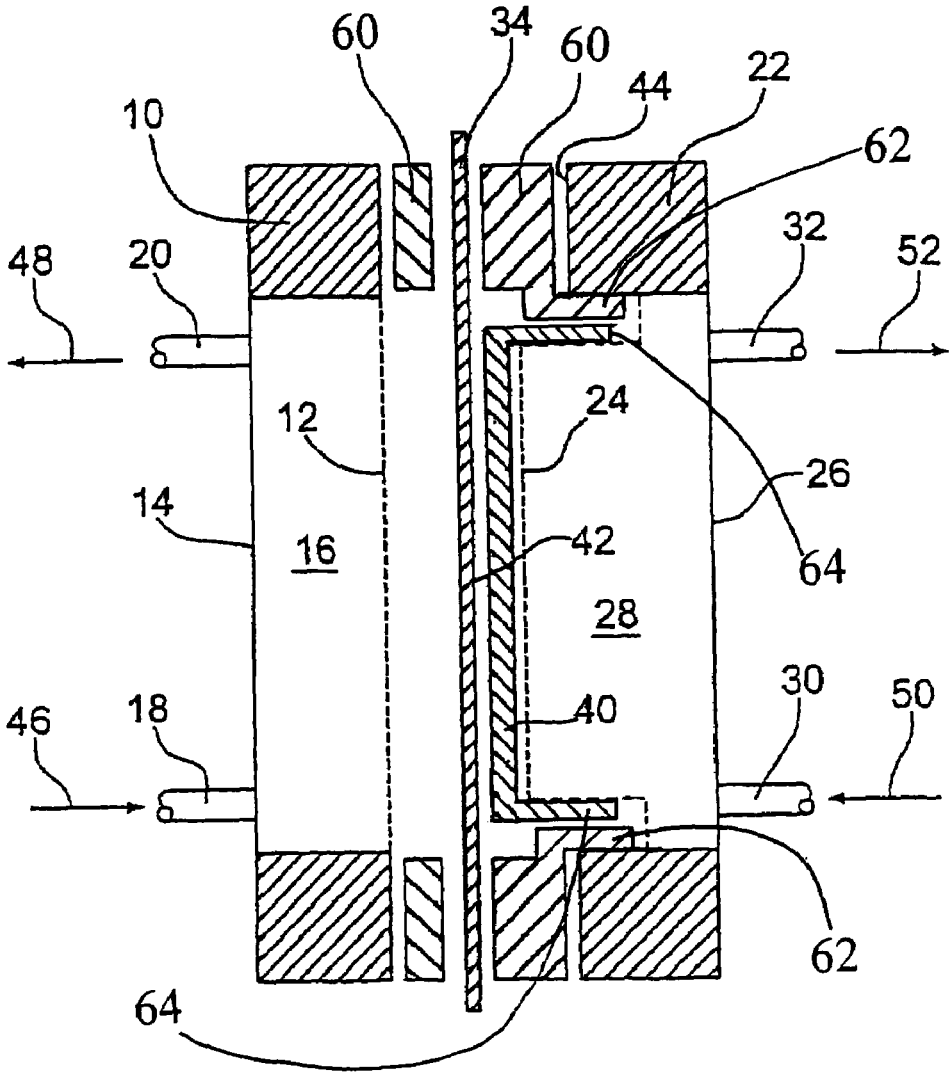
FIG. 3 shows a schematic longitudinal section of a third preferred embodiment of the electrolysis cell.
Figure 4:
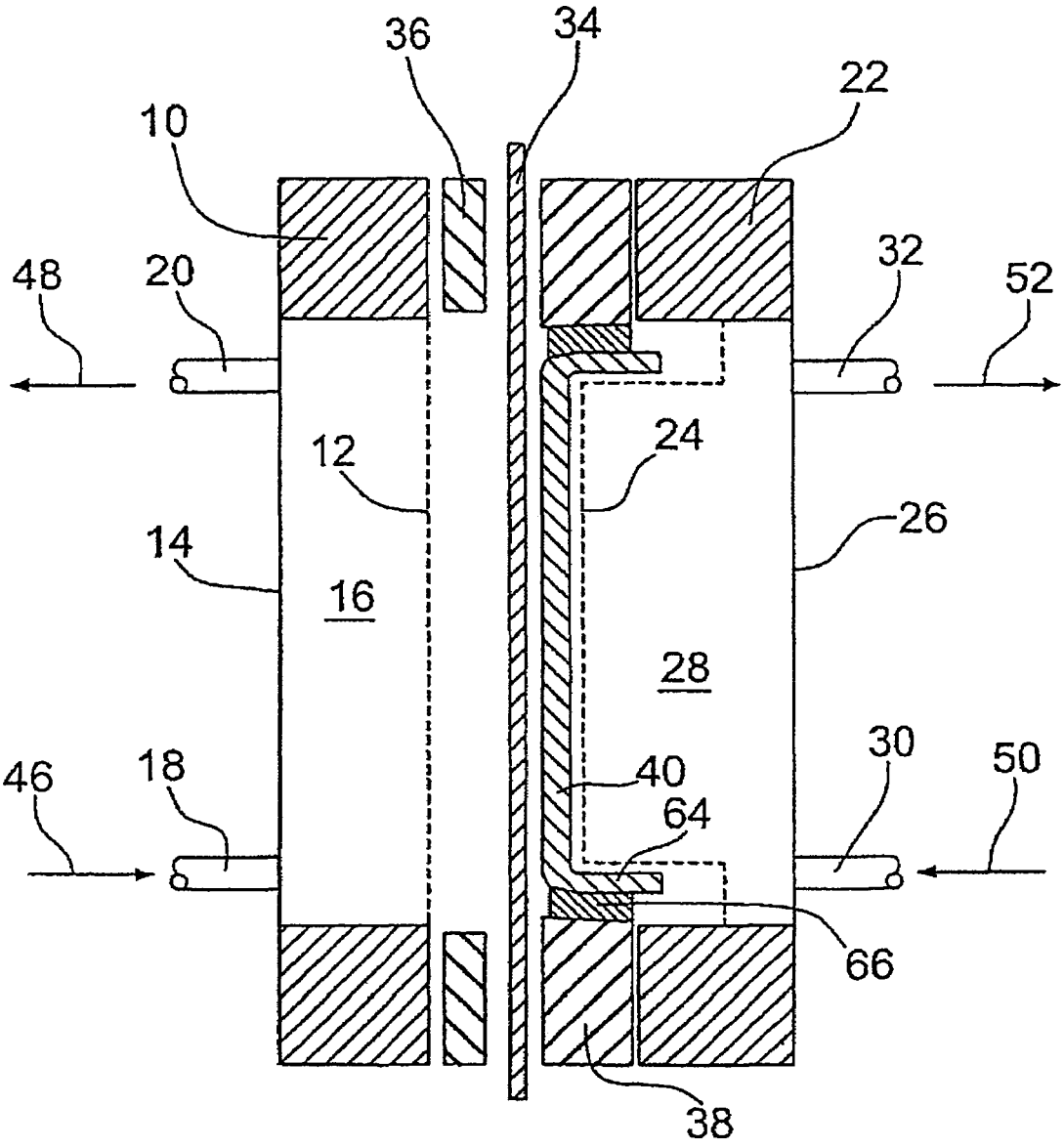
FIG. 4 shows a schematic longitudinal section of a fourth preferred embodiment of the electrolysis cell.
Figure 5:
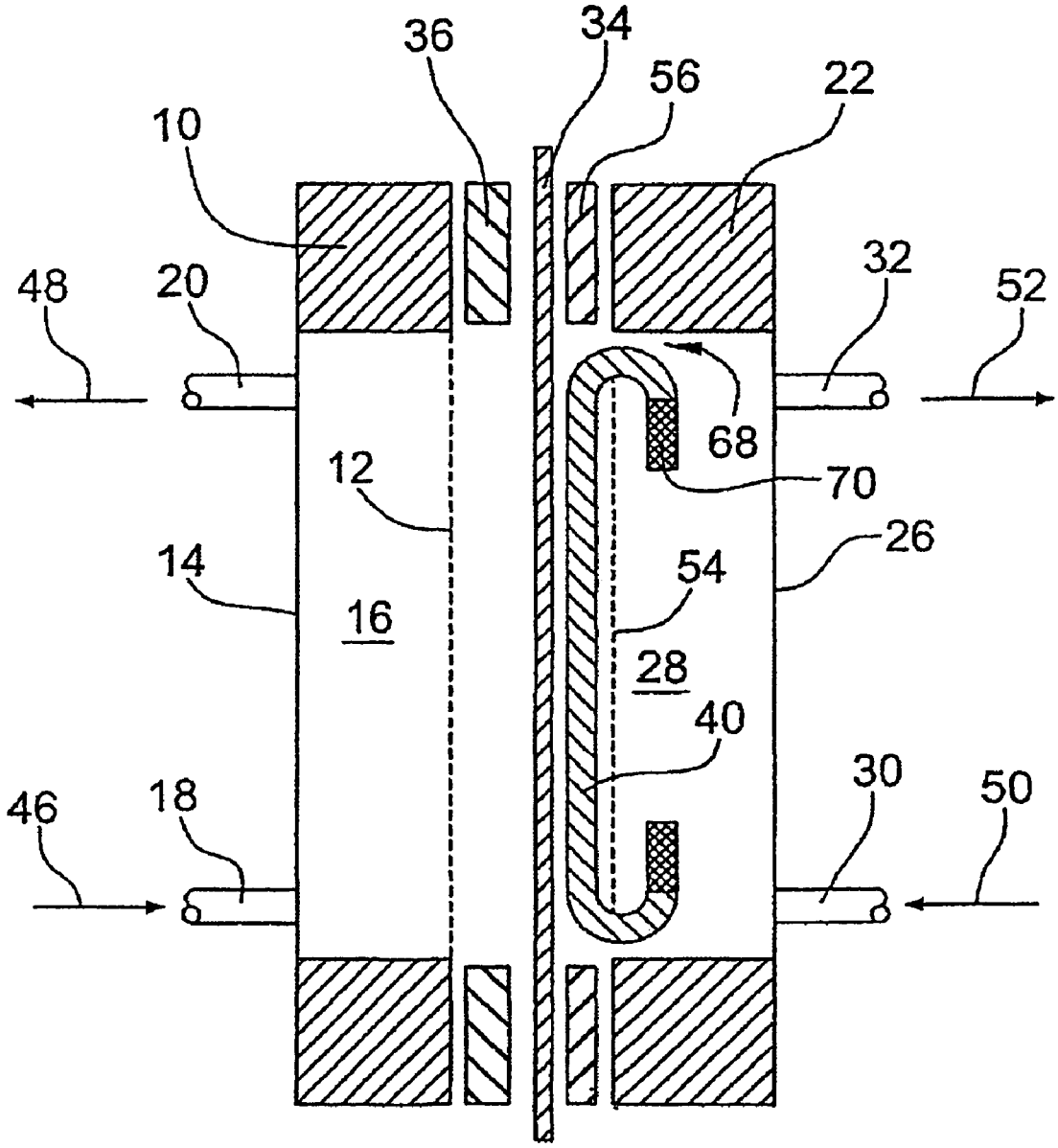
FIG. 5 shows a schematic longitudinal section of a fifth preferred embodiment of the electrolysis cell.

The substantial difference in the embodiment shown in FIG. 2 is that the current collector 54 does not project beyond the frame 22 but forms a plane with it. The current collector 54 is arranged in the same plane as the surface 44 of the cathode frame 22. A further difference arising from this is that a seal 56 which replaces the seal 38 (FIG. 1) is provided. The seal 56 is thinner than the seal 38 and may have, for example, the same thickness as the GDE 40. That surface of the GDE 40 which faces the anode 12 is thus arranged in the same plane as that surface of the seal 56 which likewise faces the anode 12. This is the case particularly in the assembled state in which the seal 56 can be compressed. Otherwise, the components of the two embodiments shown and the function of the electrolysis cells shown are identical.

In the third embodiment of the invention (FIG. 3), a seal 60 is provided between the anode frame 10 and the cathode frame 22, which seal has an extension 62 which projects into the cathode frame 22. The extension 62 is thus arranged between the cathode frame 22 and the current collector 24. For fixing of the GDE 40, the latter is bent over in the region 64 and fixed between the extension 62 of the seal 60 and the current collector 24, in particular by clamping. This fixing can be effected all around or on two sides of the current collector 24 opposite one another.

In the fourth embodiment of the invention (FIG. 4), the seal provided corresponds to the seal 38 (FIG. 1). The difference in this embodiment is that the current collector 24 is merely made smaller and an edge region 64 of the gas diffusion electrode 40 is once again bent over. For fixing the GDE 40, a resilient wedge 66 is provided between the seal 38 and the GDE 40 or the edge region 64 of the GDE 40. By means of the wedge 66, the edge region 64 of the GDE 40 is pressed against the current collector 24 and thus also fixes this. The wedge 66 is preferably frame-shaped. Furthermore, it is possible to use a plurality of individual wedges 66.

In the fifth embodiment of the invention (FIG. 5), the current collector 54 is formed substantially as in the working example shown in FIG. 2. However, the current collector 54 at least partly has a gap 68 between it and the cathode frame 22. It is possible to insert a plastics strip 70, which consists in particular of PVC, through the gap 68. The strip 70 is connected to the GDE 40. The GDE 40 is fixed to the current collector 54 by virtue of the fact that the GDE 40 grips behind the current collector 54. Particularly preferably, this embodiment additionally has, between the seal 56 and the GDE 40, a resilient wedge (not shown here) which is formed substantially as in the working example shown in FIG. 4. Preferably, the wedge runs in a frame-like manner around the GDE. However, it is also possible to use a plurality of individual wedges at regular or irregular intervals.

Figure 6:
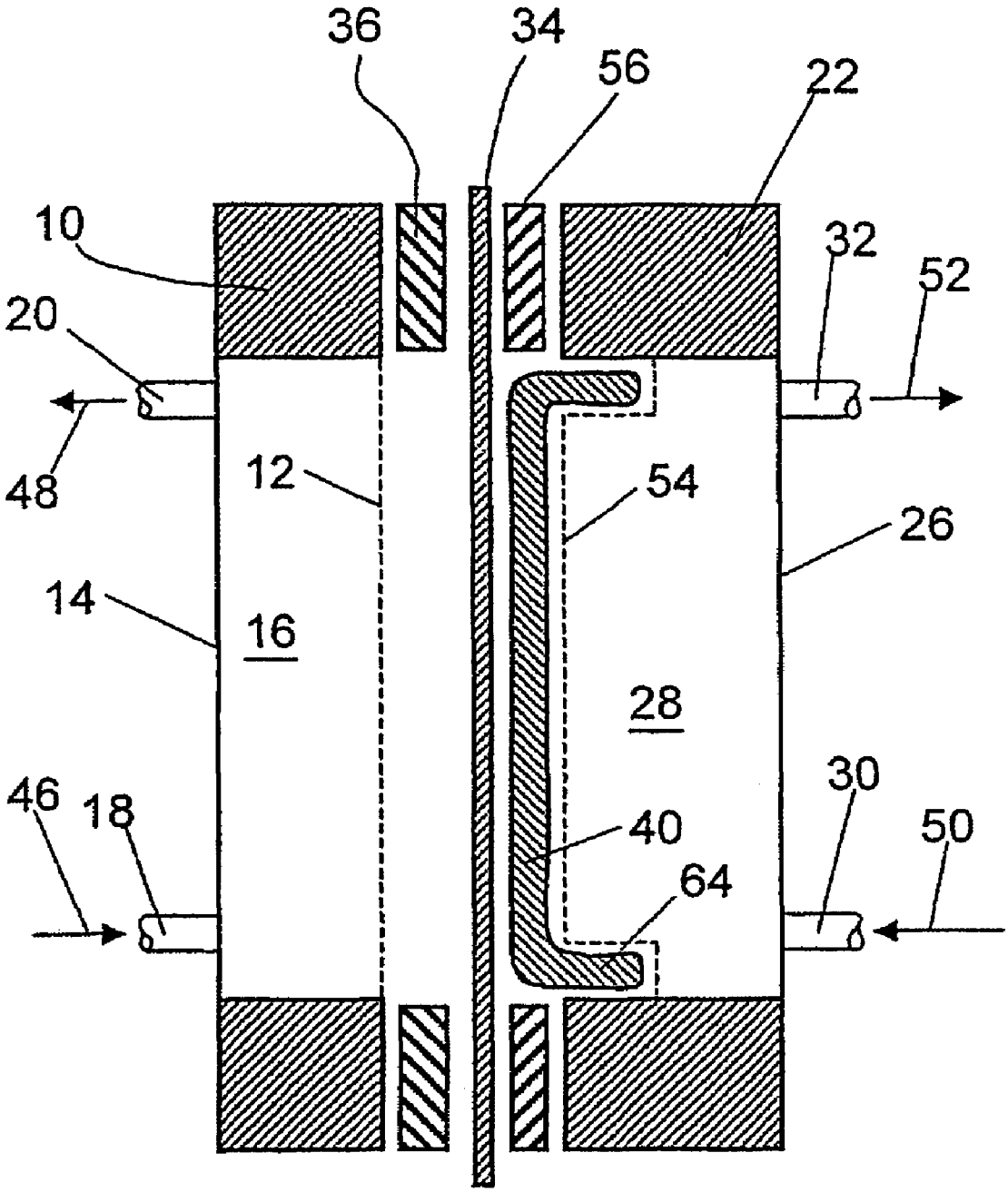
FIG. 6 shows a schematic longitudinal section of a sixth preferred embodiment of the electrolysis cell.

In the sixth embodiment (FIG. 6), the current collector 54, similarly to the embodiment shown in FIG. 2, does not project beyond the frame 22 but forms a plane with it. The difference compared with the embodiment shown in FIG. 2 is that the current collector is bent over all around at its edges. Here, the GDE 40 is bent over at its edges, the edge region 64 being inserted into the gap between cathode frame 22 and current collector 54.

The invention claimed is:

1. An electrolysis cell, suitable for the electrochemical production of chlorine from aqueous solutions of hydrogen chloride, said cell comprising:

an anode space formed from an anode, an anode frame and a back wall, the anode frame supporting the anode and the anode space having an inlet and an outlet for the electrolyte, a cathode space formed from a current collector, a cathode frame and a back wall, the cathode frame supporting the current collector and the cathode space having an inlet and an outlet for the gas, a gas diffusion electrode arranged between anode and current collector and a cation exchange membrane arranged between anode and gas diffusion electrode, wherein the gas diffusion electrode is fixed on the current collector.

2. The electrolysis cell as claimed in claim 1, wherein the gas diffusion electrode is detachably fastened to the current collector.

3. The electrolysis cell as claimed in claim 2, wherein the area of the gas diffusion electrode is such that the gas diffusion electrode projects with an edge beyond the current collector.

4. The electrolysis cell as claimed claim 2, wherein a sealing element runs along the cathode frame, that sealing surface of the sealing element which faces the anode being arranged in a plane with that surface of the gas diffusion electrode which faces the anode.

5. The electrolysis cell as claimed in claim 2, wherein the gas diffusion electrode partly grips around the current collector.

6. The electrolysis cell as claimed in claim 1, wherein the area of the gas diffusion electrode is such that the gas diffusion electrode projects with an edge beyond the current collector.

7. The electrolysis cell as claimed claim 6, wherein a sealing element runs along the cathode frame, that sealing surface of the sealing element which faces the anode being arranged in a plane with that surface of the gas diffusion electrode which faces the anode.

8. The electrolysis cell as claimed in claim 1, wherein a sealing element runs along the cathode frame, that sealing surface of the sealing element which faces the anode being arranged in a plane with that surface of the gas diffusion electrode which faces the anode.

9. The electrolysis cell as claimed in claim 8, wherein the current collector projects from the cathode frame in the direction of the cation exchange membrane and is surrounded by the sealing element running along the cathode frame.

10. The electrolysis cell as claimed in claim 9, wherein the sealing element has an extension projecting between the cathode frame and the current collector, and the edge of the gas diffusion electrode is held between the extension and the current collector.

11. The electrolysis cell as claimed in claim 6, wherein the gas diffusion electrode partly grips around the current collector.

12. The electrolysis cell as claimed in claim 9, wherein at least one resilient wedge is provided for fixing the gas diffusion electrode between the current collector and the sealing element.

13. The electrolysis cell as claimed in claim 9, wherein an edge of the gas diffusion electrode is connected to at least one strip for fixing on the current collector.

14. The electrolysis cell as claimed in claim 8, wherein the sealing element has an extension projecting between the cathode frame and the current collector, and the edge of the gas diffusion electrode is held between the extension and the current collector.

15. The electrolysis cell as claimed in claim 14, wherein at least one resilient wedge is provided for fixing the gas diffusion electrode between the current collector and the sealing element.

16. The electrolysis cell as claimed in claim 14, wherein an edge of the gas diffusion electrode is connected to at least one strip for fixing on the current collector.

17. The electrolysis cell as claimed in claim 8, wherein at least one resilient wedge is provided for fixing the gas diffusion electrode between the current collector and the sealing element.

18. The electrolysis cell as claimed in claim 8, wherein an edge of the gas diffusion electrode is connected to at least one strip for fixing on the current collector.

19. The electrolysis cell as claimed in claim 1, wherein the gas diffusion electrode partly grips around the current collector.

20. The electrolysis cell as claimed in claim 1, wherein an edge of the gas diffusion electrode is connected to at least one strip for fixing on the current collector.

* * * * *